US005779467A

United States Patent [19]

Gardner

[11] Patent Number: 5,779,467

[45] Date of Patent: Jul. 14, 1998

[54] METHOD AND APPARATUS FOR PREHEATING PARTICULATE MATERIAL

[75] Inventor: Kenneth LeRoy Gardner, Riverside, Pa.

[73] Assignee: Svedala Industries, Inc., Waukesha, Wis.

[21] Appl. No.: 795,690

[22] Filed: Feb. 4, 1997

[51] Int. Cl.[6] ..... F27B 15/18; F27B 9/40; F27B 7/02; F27D 1/08

[52] U.S. Cl. ..... 432/17; 432/37; 432/98; 432/106

[58] Field of Search ..... 432/36, 37, 17, 432/98, 106

[56] References Cited

U.S. PATENT DOCUMENTS

| | | | |
|---|---|---|---|
| 2,797,498 | 7/1957 | Jipp | 34/167 |
| 3,064,833 | 11/1962 | Von Ruden | 414/301 |
| 3,403,895 | 10/1968 | Harfield et al. | 432/98 |
| 3,576,262 | 4/1971 | Konchesky et al. | 193/3 |
| 3,832,128 | 8/1974 | Paul | 432/17 |
| 3,903,612 | 9/1975 | Warshawsky et al. | 432/106 X |
| 3,947,239 | 3/1976 | Nelson | 432/14 |
| 4,088,438 | 5/1978 | Deussner et al. | 432/106 |
| 4,134,738 | 1/1979 | Bress et al. | 48/85.2 |
| 4,207,061 | 6/1980 | Ikenaga et al. | 432/98 |
| 4,243,379 | 1/1981 | Horn et al. | 432/14 |
| 4,294,019 | 10/1981 | Seitmann | 34/167 |
| 4,316,681 | 2/1982 | Sida | 406/162 |
| 4,337,031 | 6/1982 | Gardner et al. | 432/98 |
| 4,555,210 | 11/1985 | Wigram | 414/301 |
| 4,599,068 | 7/1986 | Janssen et al. | 432/106 X |
| 4,629,421 | 12/1986 | Kreisberg et al. | 432/106 X |
| 4,820,108 | 4/1989 | Kneer | 414/301 |
| 4,948,364 | 8/1990 | Thompson | 432/98 |
| 5,324,159 | 6/1994 | Nowobilski et al. | 414/301 |

OTHER PUBLICATIONS

Quittkat et al., Planung und Inbetriebsetzung einer Drehofenanlage zur Herstellung von 600–t/d–Stahlwerks–Kalk in Wuhan/Volksrepublik China, Zement–Kalk–Gips No. 7, pp. 370, 1981.

Quittkat et al., Design and commissioning of a rotary kiln plant for production of 600 tpd lime for the Wuhlan Steelworks, People's Republic of China, Zement–Kalk–Gips No. 9, pp. 202–208, 1981

*Primary Examiner*—Christopher Kilner
*Attorney, Agent, or Firm*—Kinney & Lange, P.A.

[57] ABSTRACT

A preheating apparatus for particulate material includes a plurality of vertical chambers, a temperature sensor within each chamber and a particulate discharge mechanism. Each chamber is segregated from an adjacent chamber by a vertical wall and includes a material inlet for receiving particulate material, a material outlet for discharging particulate material, a gas inlet for receiving a gas, and a gas outlet for exhausting gas. The temperature sensor is located within a chamber so as to sense temperature of the gas being exhausted from each chamber. A particulate discharge mechanism discharges particulate material within each chamber through the material outlet, with a flow rate adjusted as a function of temperatures sensed by the temperature sensor. A method for preheating particulate material includes sensing temperature of the gas existing each chamber and adjusting a flow rate of the particulate material through each chamber as a function of sensed temperature of each chamber.

21 Claims, 7 Drawing Sheets

METHOD AND APPARATUS FOR PREHEATING PARTICULATE MATERIAL

BACKGROUND OF THE INVENTION

The present invention relates to a method and apparatus for preheating material with the hot gas being exhausted from a heater or kiln. In particular, the present invention relates to a preheating method and apparatus which more efficiently uses the energy of the hot gas to uniformly heat particulate material, even if the particulate material is not entirely uniform in itself.

Preheaters are commonly used for preheating many types of particulate material. One common use for preheaters is for preheating limestone particulate material. The limestone particulate material is generally preheated by inducing hot exhaust gases from a rotary calcining kiln through the limestone particulate material prior to placement of the limestone particulate into the calcining kiln. The gases heat the limestone particles prior to their introduction to the rotary kiln, and less heating is required in the rotary kiln to complete the calcining process. The preheater thus makes the entire calcining process more efficient and saves energy. Preheating apparatuses of this general type are known and described in prior art patents including U.S. Pat. Nos. 3,601,376; 3,832,128; 3,903,612; 4,337,031 and the prior art discussed and cited therein.

Several preheaters use a countercurrent heat exchange relationship, wherein the hot exhaust gas is directed opposite to the direction of flow of the particulate material. The countercurrent heat exchange relationship places the hottest exhaust gas against the warmest section of the particulate material, and vice versa, such that efficient heating occurs throughout the preheater.

In using a preheater, the limestone is typically supplied by conveyor to an overhead storage bin positioned above the preheater. The preheater may be located over a rotary kiln. In a preheating apparatus such as that disclosed in U.S. Pat. No. 4,337,031, an annular preheating passage extends between the overhead storage bin and a central discharge which is in communication with the rotary kiln. As the limestone is directed downwardly through the preheating passage, hot exhaust gases from the kiln move upward through the limestone particulate material.

While preheaters make limestone calcining and other similar processes more efficient, advances in preheater design can be made to obtain further benefit, make the preheater more efficient, and save even more energy.

SUMMARY OF THE INVENTION

The present invention is an improved method and apparatus for preheating particulate material. A sensor is placed in the preheater to measure the preheating gas as it exits the preheater. For instance, a temperature sensor may be used to directly measure the temperature of the gas as it leaves the preheater chamber. The preheating operation is modified based on the measurement taken. In the preferred embodiment, the preheater is partitioned by separation walls into a plurality of substantially distinct preheating chambers. Hot gas is separately channeled through the particulate material in each chamber. The flow rate of the particulate material through each chamber is adjusted relative to the other chambers based upon the sensed temperature from each chamber, while the overall flow rate of particulate material through the preheater is retained constant. In one preferred embodiment, a plunger feeder reciprocates at a frequency selected based upon the sensed temperature. In another preferred embodiment, the plunger feeder reciprocates with a stroke distance selected based upon the sensed temperature.

DETAILED DESCRIPTION OF THE PREFERRED EMBODIMENTS

Figure 1:
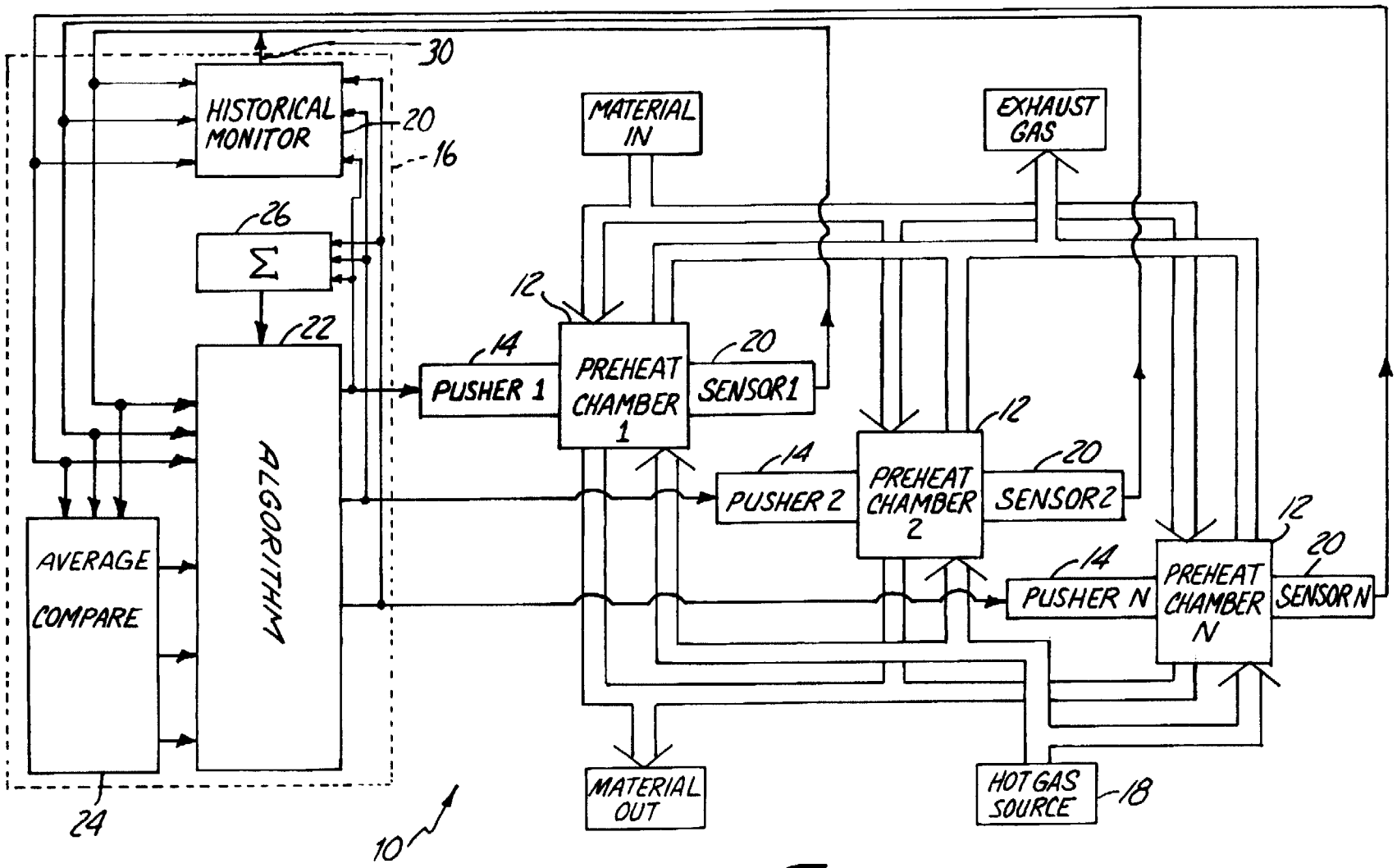
FIG. 1 is a block diagram of the operation of the present invention.

The present invention is a preheater 10 which is conceptually represented in the block diagram of FIG. 1. The preheater 10 can be used with a large variety of particulate materials, but is particularly designed and intended to preheat and precalcine limestone. The preheater 10 can also be used with a variety of heating fluids, but is particularly designed and intended to heat with exhaust gases received from a calcining kiln.

Preheater 10 includes one or more substantially separate chambers 12 for preheating particulate material. A particulate material pusher 14 is associated with each chamber 12. The operation of each particulate material pusher 14 is controlled by signals from a controller 16. Based on the signals received from the controller 16, each material pusher 14 propels particulate material through its respective chamber 12.

Each chamber 12 receives hot gases from a hot gas source 18, such as from a limestone calcining kiln. Hot gases are induced through the particulate material within each chamber 12 to preheat the particulate material.

A sensor 20 is also associated with each chamber 12. In the preferred embodiment, each sensor 20 is a thermocouple or other temperature sensing device which determines the temperature of the heating gases as they exit from the chamber 12. Each sensor 20 provides a signal indicative of exit gas temperature to the controller 16.

Controller 16 uses the information from the sensors 20 in an algorithm 22 to determine the operation of the material pushers 14. In the preferred controller 16, an average/compare function 24 is also used with the algorithm 22. That is, the signals (temperatures) from each of the sensors 20 of the chambers 12 are averaged, and then the temperature from each chamber 12 is compared to the average. Information as to whether a chamber 12 is operating at a higher-than-average or lower-than average temperature is used in the algorithm 22 to control the operation of material pushers 14. Generally speaking, the information is used by algorithm 22 so that material pushers 14 in chambers 12 having a higher temperature are operated at a higher rate or frequency than material pushers 14 in chambers 12 having a lower temperature.

Differences in gas outlet temperatures between chambers 12 is a primary indicator of non-uniform heat transfer occurring in the different chambers 12. A high temperature reading indicates that heat energy of the hot gas in that chamber 12 is not being efficiently and uniformly transferred from the hot gas to the particulate material. A low temperature reading may indicate that the chamber 12 is not obtaining a sufficient flow of hot gas, and the gas passages within the chamber 12 may be blocked. Non-uniform heat transfer causes differences in the amount of preheating occurring in each of the respective chambers 12, and reduces the overall efficiency of the preheater 10. The non-uniform heat transfer and corresponding reduced heat transfer efficiency may be due to any of several different causes.

The most likely cause for the reduced heat transfer efficiency is that coarser material in that chamber 12 has caused a relatively higher gas flow rate. For instance, limestone particulate material typically includes a range of different particle sizes. Small limestone particles provided in a batch of limestone particulate material may be ¼th the size of the large limestone particles in the same batch or smaller. When the limestone particulate material is supplied to preheater 10 by a belt conveyor feeding device, some segregation of particles typically occurs based on particle size. In particular, the largest particles become concentrated in one portion of the preheater 10, and smaller sized particles become concentrated in a second portion of the preheater 10. The differently sized limestone particles remain segregated from one another and tend to flow through different chambers 12. The large particles do not compact together as tightly as the smaller particles, and the larger particles provide a flow path for the preheating gas which is more direct and has fewer turns or zig-zags. Because the hot kiln gases tend to follow a path of least resistance towards the gas exhaust, the hot kiln gases have a higher gas flow rate through larger, coarser particles as compared to smaller particles. As a result, the heating gases exiting a chamber 12 with coarse stones have a higher temperature than the gases exiting other chambers 12.

A second possible cause for non-uniform heat transfer is a restricted material flow through the chamber 12. If new, cooler particulate material is not being moved into the chamber 12, and if preheated particulate material is not being moved out of the chamber 12, then all of the particulate material within the chamber 12 will approach the temperature of the hot gas entering the chamber 12. When the particulate material is already fully warmed, no additional heating takes place, and the gas at the outlet remains nearly as hot as it was when it came in.

The measured temperature of the exhaust gas is used by the controller 16 to control the operation of preheater 10. The preferred method to control the preheating process is to automatically control the rate at which particulate material is moved through the chamber 12. An alternative method to control the preheating process is to automatically control the rate at which hot gas is moved through the chamber 12.

It will be appreciated by workers skilled in the art that parameters other than exhaust gas temperature may alternatively be used to monitor the efficiency of heat transfer within each chamber 12. For instance, the flow rate of the exhaust gas can be monitored. A higher gas flow rate in one chamber is similarly indicative of coarser material in that chamber and less efficient heating in the preheater than otherwise could be taking place. Alternatively, the pressure of the exhaust gas can be monitored, and corresponds to the flow rate of the gas. Temperature, flow rate or pressure measurement can be taken at any selected location within each chamber 12, and does not have to occur at the gas outlet. As another example, the temperature of the stone exiting the chamber 12 can be monitored as being indicative of the efficiency of heating within that chamber 12.

Because controller 16 has control over the rate of all the material pushers 14, the entire system may be controlled to maintain a constant desired throughput of particulate material. Accordingly, the controller 16 determines a sum 26 of the rates of all the respective material pushers 14. When the rate of material flow in one chamber 12 is increased, the rate of material flow in the other chambers 12 is correspondingly decreased, such that the total material throughput of the preheater 10 remains constant. The preheater chamber 12 which registered a higher exhaust temperature prior to the adjustment operates at a higher throughput, causing its outlet gas temperature to decrease to match the other chambers 12.

The flow rate of particulate material in each chamber 12 is varied so that preheating occurs as efficiently as possible in the preheater 10 as a whole. Controller 16 preferably operates each of the material pushers 14 on an independent but interrelated feedback loop, such that the rate of material flow of the overall system is constant, and such that the outlet gas temperature is approximately the same in each of the chambers 12.

After the operation of a material pusher 14 of the preheater 10 is modified based on the parameter measured by sensor 20, a historical register or monitor 28 may be used to record the performance of each of the chambers 12 relative to the rate of the material pushers 14. For instance, the historical monitor 28 can verify that modification of the rate of a material pusher 14 produces the expected change in gas outlet temperature. If the operating rate for a material pusher 14 for a particular chamber 12 has been increased, the sensed temperature of the outlet gas for that chamber 12 should show an overall reduction. If the overall reduction in outlet temperature for that chamber 12 is not attained, other problems may be present in the system. A real time output 30 from the historical monitor 28 may be provided to allow a human operator to review the current and previous temperatures of each of the chambers 12 relative to the rates of the respective material pushers 14.

If the material pushers 14 for each chamber 12 are activated intermittently, the exhaust gas temperature of each chamber 12 should follow a consistent pattern, being the highest immediately prior to activation of the material pusher 14 and being lowest shortly after activation of the material pusher 14. If the historical monitor 28 does not show this response, then the chamber 12 may have other problems. For instance, the material flow in the chamber 12 may be obstructed, such that the desired material flow rate is not reached even though the rate of the material pusher 14 has been increased. The material pusher 14 may not be operating properly. Alternatively, the gas flow through a chamber 12 may be clogged. Having a separate sensor 20 and recording separate temperatures for each chamber 12 with historical monitor 28 allows such problems to be identified much more readily.

The preheater 10 of the present invention accordingly permits a more efficient preheating operation, even if the particulate material is not entirely homogeneous throughout the preheater 10. Relative adjustments in the material flow rates in each of the chambers 12 may be made continuously during operation of the preheater 10. Problems which may occur in the preheater 10 can be much more readily and accurately diagnosed and addressed.

Application of the present invention in a physical structure is shown and described with reference to FIGS. 2–9. Other than being modified to incorporate the present invention, the preheater 10 of FIGS. 2–9 is as described in U.S. Pat. No. 4,337,031, entitled "PREHEATING APPARATUS". U.S. Pat. No. 4,337,031 was invented by Gardner et al. and assigned to Kennedy Van Saun, which merged with the Assignee of the present application, Svedala Industries, Inc., and is incorporated herein by reference.

The preheater 10 includes a particulate material inlet 32 and a discharge or particulate material outlet 34. The particulate material outlet 34 empties particulate material through a transfer conduit into a rotary kiln 36. The upper portion of the preheater 10 includes an annular storage bin 38 which is connected to the chambers 12 by one or more chutes 40. In the embodiment shown and as viewed in FIG. 3, the preheater 10 includes ten chambers 12. The number of chambers 12 used for any particular design depends on the flow rate required for the preheater 10 and the kiln 36. For instance, if a limestone material flow rate of 1200 tons per day is desired for the kiln 36, a preheater 10 with approximately eighteen chambers 12 may be appropriate. In the preferred embodiment, each chamber 12 has its own feeding chute 40. For ease of construction and economy, the preheating apparatus 10 is preferably a modular construction with each chamber 12 being provided by a separate module.

The upper portion of the containment structure 10 includes an annular hopper structure or storage bin 38. The storage bin 38 is defined by a roof 42, a central base 44 which may be conical and extend downwardly and outwardly, and an outer base 46 which may be conical and extend downwardly and inwardly. The limestone introduced through the inlet 32 is received into the storage bin 38.

The storage bin 38 empties particulate material through a plurality of chutes 40 into the plurality of chambers 12, with one chute 40 for each chamber 12. During initial filling of the preheater 10, particulate material fills each chamber 12 up to the level of the bottom of its chute 40, then completely fills each chute 40, and then fills the storage bin 38. Particulate material is then moved through the preheater 10 by pushing particulate material at the bottom of a chamber 12 out through the particulate material outlet 34. As particulate material is pushed out of the chamber 12, new particulate material flows due to gravity through the chute 40 to refill the chamber 12 to the level of the chute 40.

Each chamber 12 is defined by a roof 48, an inner wall 50, an outer wall 52, two adjacent separation walls 54, and a sloped floor 56. The roof 48, the inner wall 50, the outer wall 52, the separation walls 54, and the sloped floor 56 are all insulated by refractory materials for a more efficient preheating operation.

A "poke-hole" door or access door 58 is preferably provided in the outer wall 52 of each chamber 12. Workers skilled in the art will appreciate that the access doors can be strategically positioned as necessary to provide the easiest access to the interior of the chambers in any style of preheater. For instance, alternatively or in addition to the access doors 58 shown, access doors could be provided in other locations, such as elsewhere in the outer wall 52, in the roof 48 or in inner wall 50. The preferred access doors 58 are square doors about six inches wide. The access doors 58 allow cleaning of the chambers 12 from exterior of the preheater 10. If desired, the access door 58 may be left open during use of the preheater 10 to permit inspection of the interior of the preheater 10 during operation.

Particulate material flows downwardly within each chamber 12 toward the discharge 34. While the particulate material is within the chambers 12, hot kiln gases from the kiln 36 flow in a countercurrent direction to preheat and precalcine the particulate material prior to its discharge and its introduction into the kiln 36. The movement of the hot gases through the particulate material is shown by arrows in the drawings.

Figure 4:
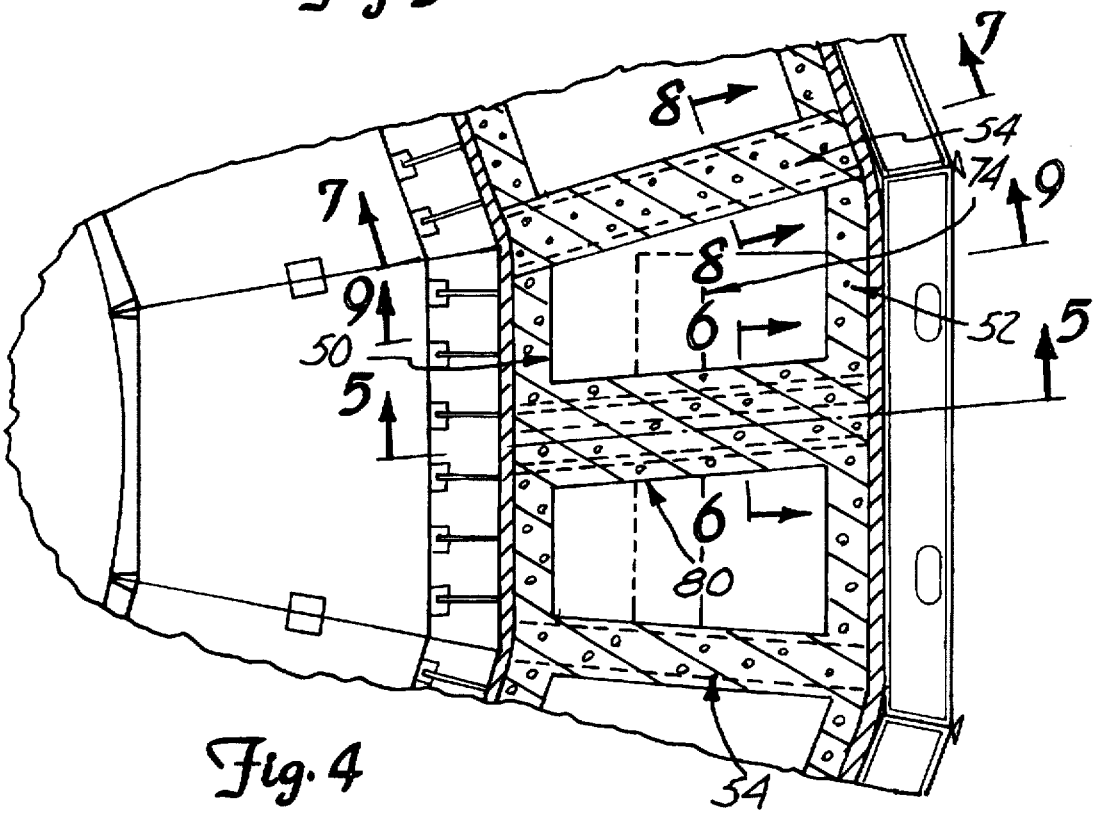
FIG. 4 is a partial top plan view in cross section of the preheater of FIG. 3.
Figure 8:
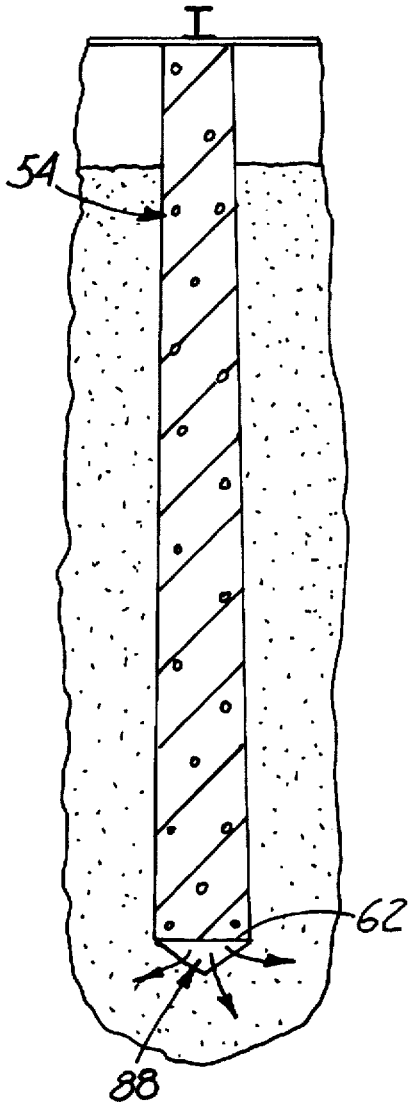
FIG. 8 is a side cross-sectional view taken along line 8—8 of FIG. 7.
Figure 7:
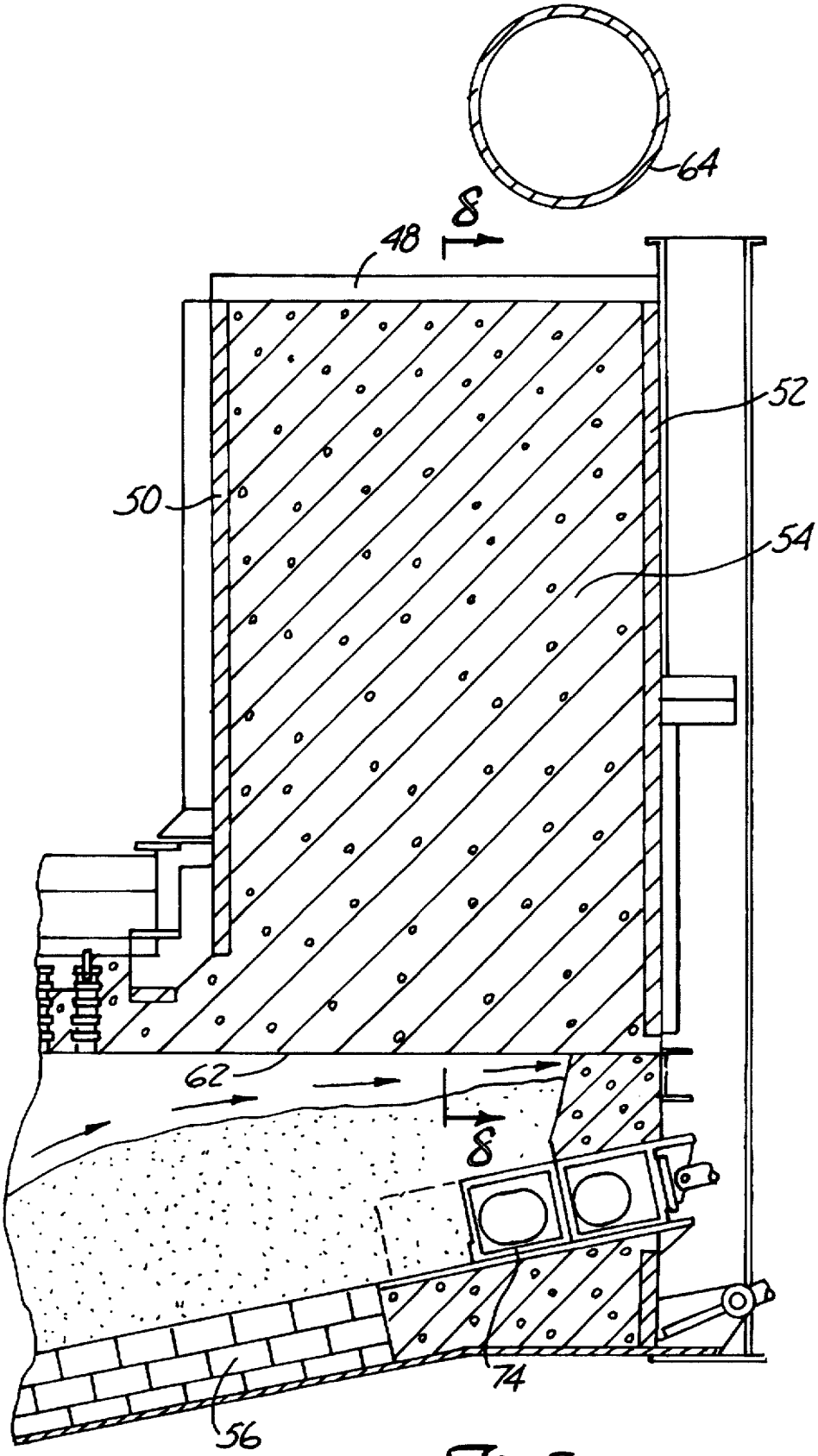
FIG. 7 is an elevational cross-sectional view taken along line 7—7 of FIG. 4.
Figure 9:
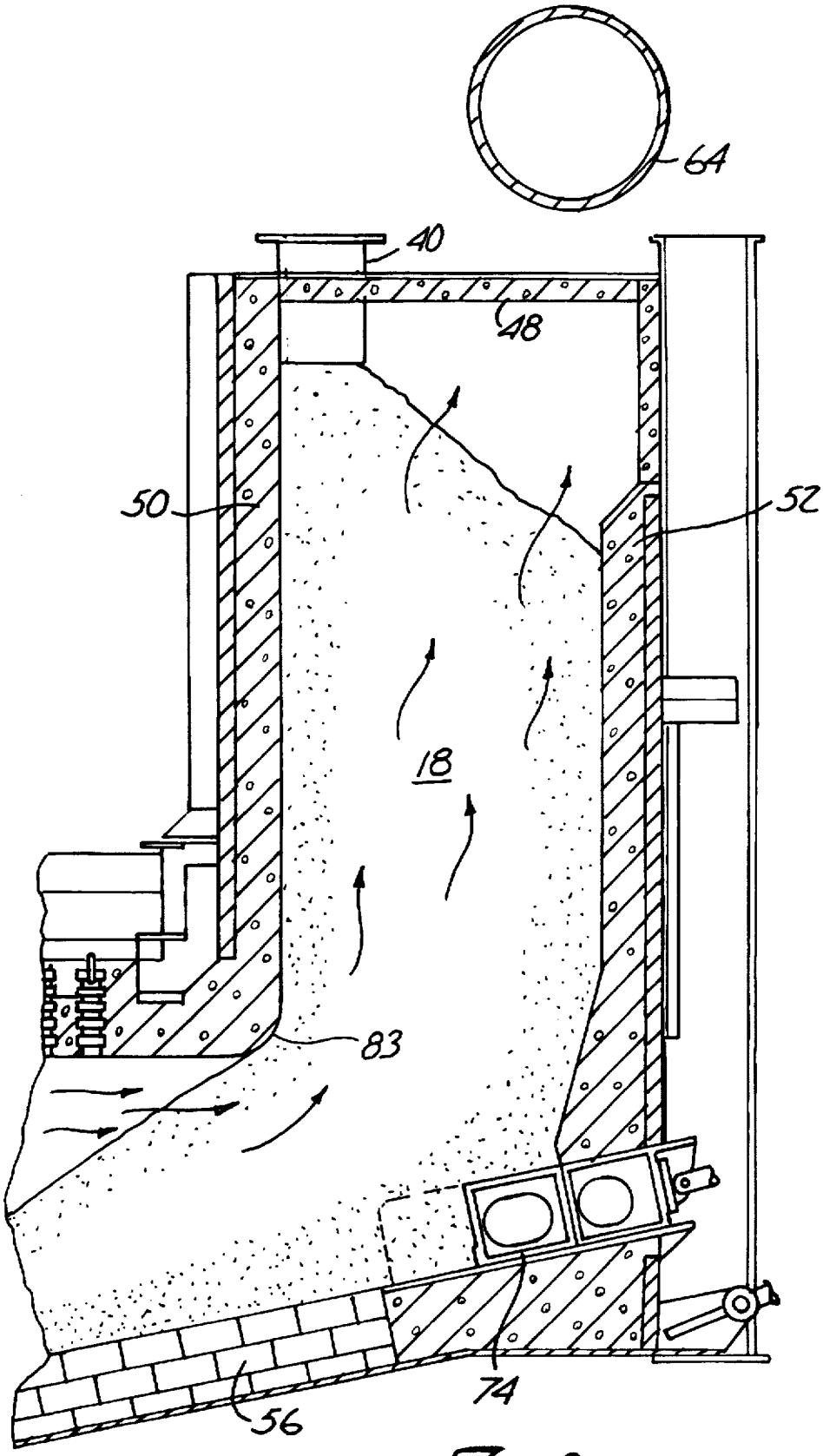
FIG. 9 is an elevational cross-sectional view taken along line 9—9 of FIG. 4.

Boundaries between each chamber 12 are formed by vertically extending separation walls 54, best seen in FIGS. 4, 7 and 8. Each separation wall 54 preferably extends from the roof 48 downward to a bottom edge 62 raised somewhat above the floor 56. Preferably the bottom edge 62 of the separation wall 54 is located at the level of the bottom of inner wall 50. The separation walls 54 partition the preheater 10 into a plurality of substantially distinct chambers 12, and the flow of both particulate material and gas within each chamber 12 occurs separate from the flow in other chambers 12.

Figure 5:
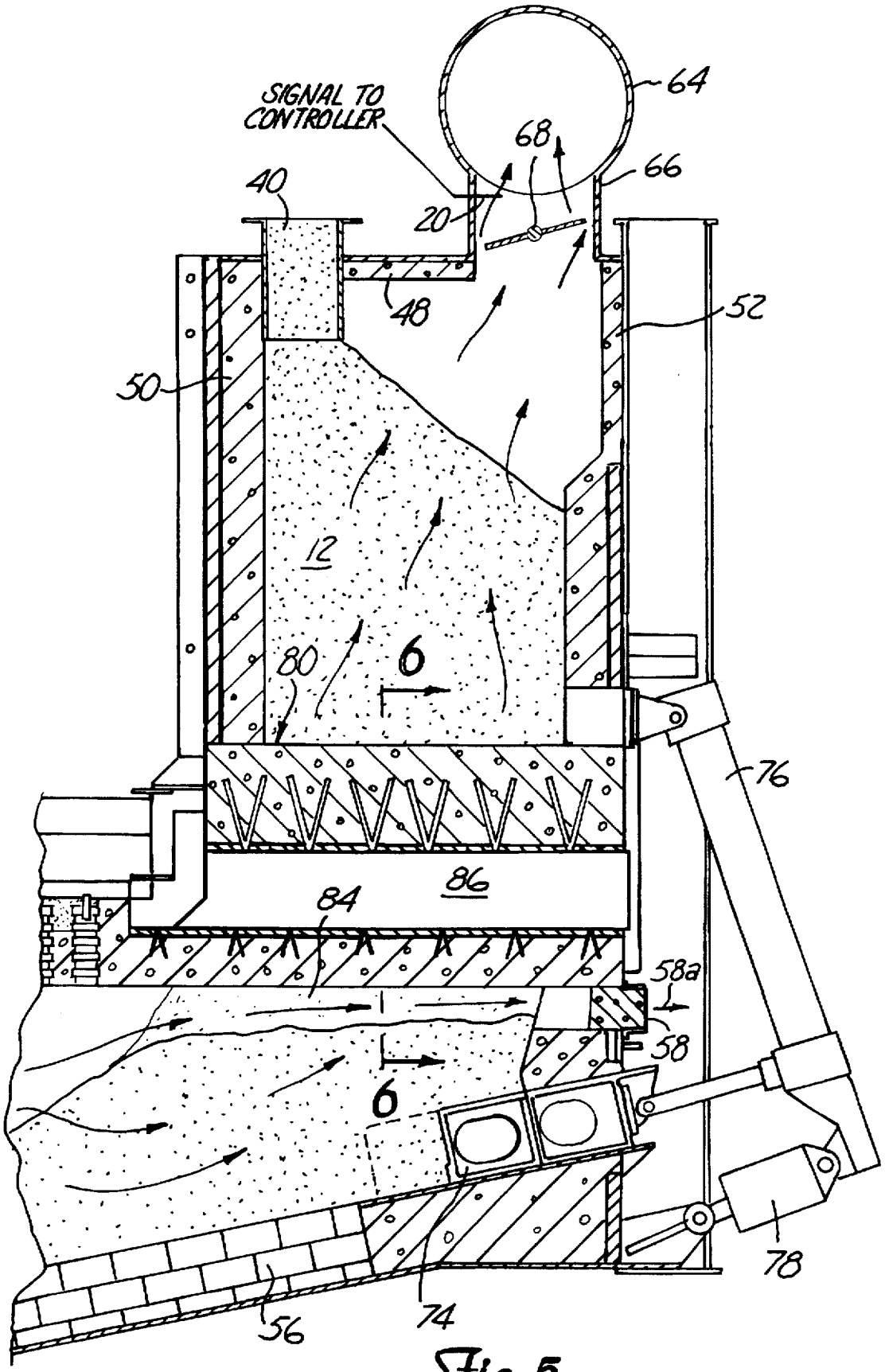
FIG. 5 is an elevational cross-sectional view taken along line 5—5 of FIG. 4.

The preheater 10 includes an exhaust bustle 64 which extends circumferentially above the chambers 12. Preferably, a pair of exhaust bustles 64 are used on opposite sides of the preheater 10 to collect the exhausted gas. As best shown in FIG. 5, each of the chambers 12 has an exhaust outlet 66 which is in fluid communication with the exhaust bustle 64. A damper 68 may be provided to regulate exhaust flow through the exhaust outlet 66 into the exhaust bustle 64. The exhaust bustles 64 are preferably ducts which extend around the perimeter of the preheater to receive gas exhausted through the exhaust outlet 66 of each chamber 12.

Figure 2:
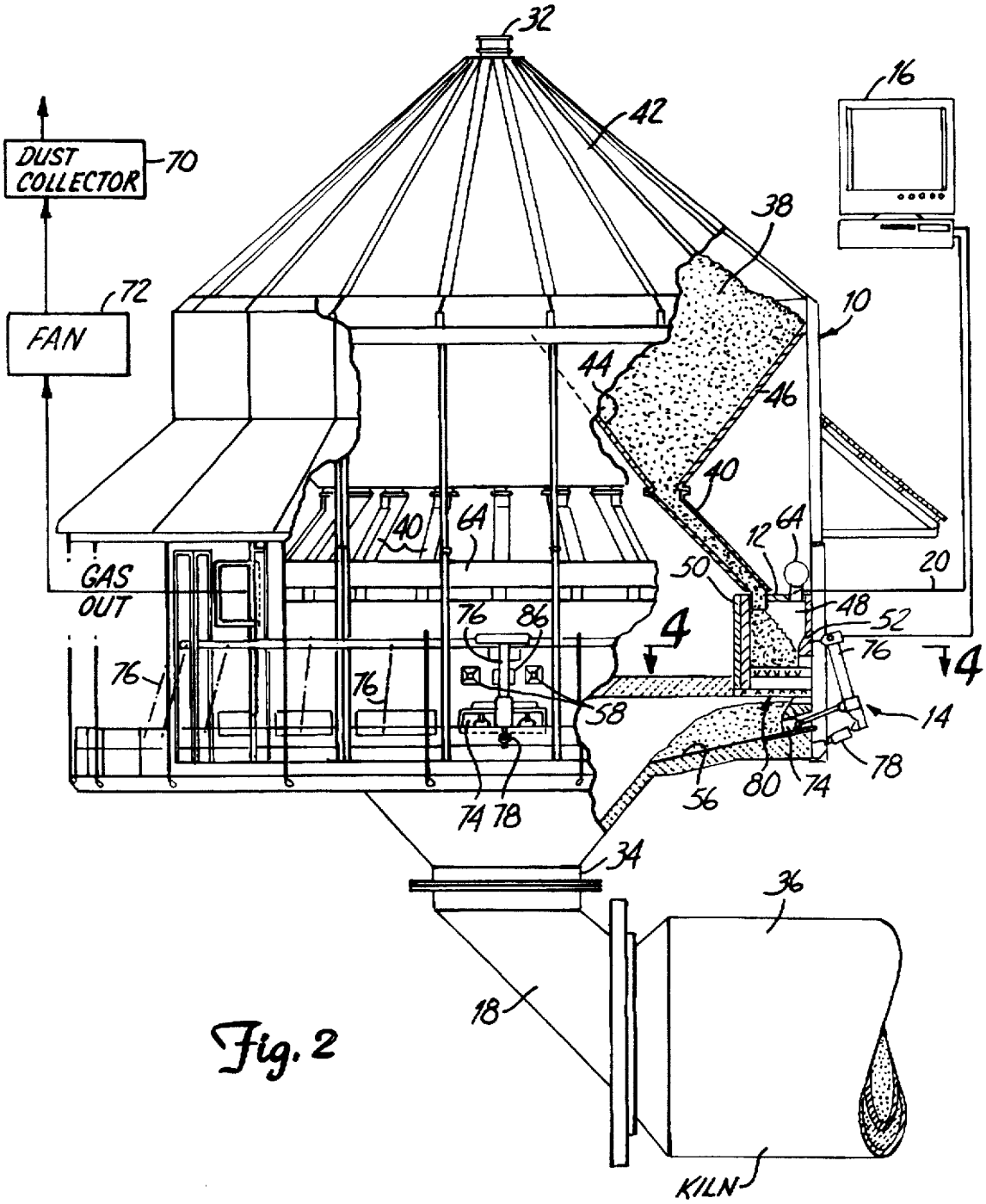
FIG. 2 is an elevational view of a preheater incorporating the present invention shown partly in cross section and with portions of the exterior wall broken away.
Figure 3:
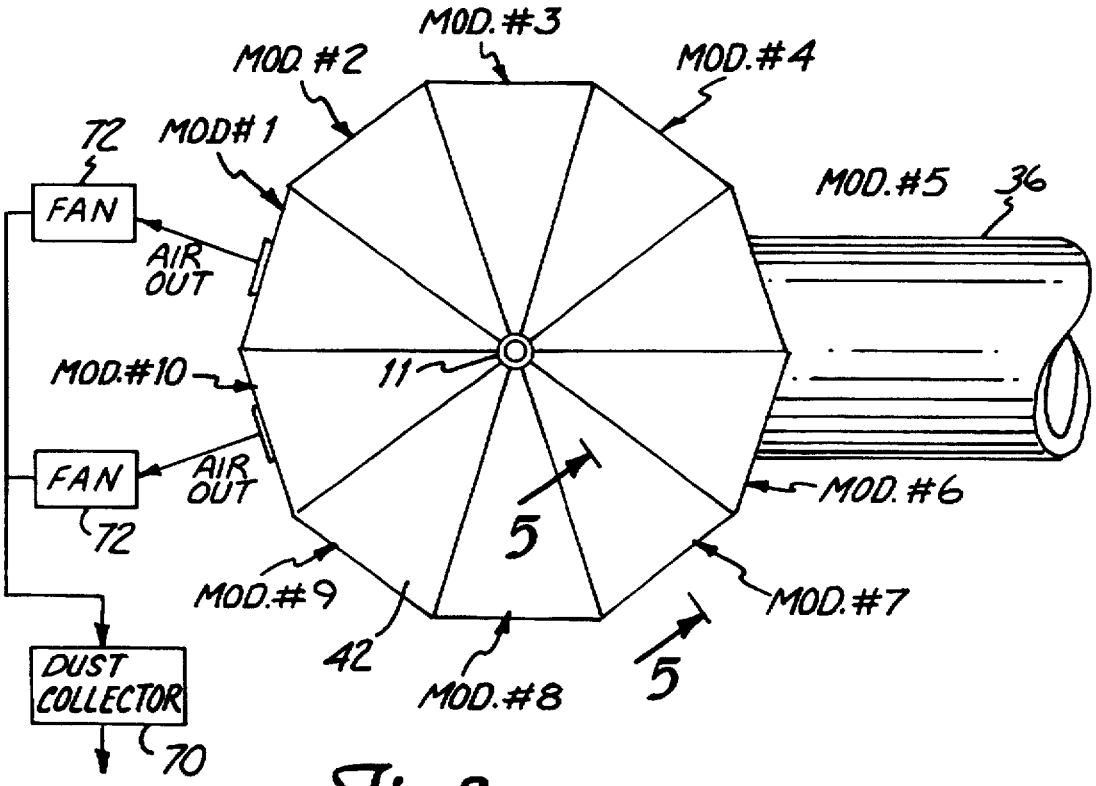
FIG. 3 is a top plan view of the preheater of FIG. 2.

The exhaust bustles 64 discharge the collected gas to a dust collector 70 (shown schematically in FIGS. 2 and 3). For instance, an induced draft fan 72 (shown schematically in FIGS. 2 and 3) may be used with the exhaust bustles 64 to propel the exhaust gases to the dust collector 70. The induced draft fan 72 also produces a below-ambient pressure in the exhaust bustles 64 and in each chamber 12 to help draw the hot gas through the particulate material in each chamber 12.

After the particulate material is preheated in the chamber 12, a material pusher 14 propels particulate material to the material outlet 34. The preferred material pusher 14 includes a plunger feeder 74 located along the floor 56 and below the bottom edge 62 of the separation walls 54. As best shown in FIG. 4, the width of the plunger feeder 74 is preferably slightly smaller than the width of each chamber 12 measured at the point where the plunger feeder 74 is fully extended. Plunger feeder 74 is reciprocally movable between a retracted position (shown in continuous lines) and an extended position (shown in FIGS. 4, 5, 7 and 9 in dashed lines). When the plunger feeder 74 is activated, it pushes material downward along the floor 56 to the outlet 34. Locating the plunger feeder 74 beneath the bottom edge 62 of the separation walls 54 reduces wear on the walls 54 due to the movement of particulate material pushed by the plunger feeder 74.

Each plunger feeder 74 is driven by an actuator 76 and a hydraulic cylinder 78. When a ram or hydraulic cylinder 78 is activated, the corresponding plunger feeder 74 moves inwardly, pushing the preheated and precalcined limestone through the discharge outlet 34 for transfer to the rotary kiln 36.

The sequence of operation of the plunger feeders 74, (i.e., the timing of when each hydraulic cylinder 78 is activated)

is electronically controlled by controller 16. Preferably the controller 16 operates the plunger feeders 74 one at a time, with no two plunger feeders 74 being activated at the same time. This prevents any dilution of power between plunger feeders 74 such as might occur if all the plunger feeders 74 were activated simultaneously using a single hydraulic system. Activating the plunger feeders 74 one at a time also prevents any clogging of material outlet 34. Activating the plunger feeders 74 one at a time also keeps any particulate material from being compressed between adjacent plunger feeders 74 during activation, and avoids the resultant wear and/or damage of the plunger feeders 74 which could be caused thereby. Each of the plunger feeders 74 may be operated intermittently. For instance, the duration of a stroke of one plunger feeder 74 may only take a few seconds, but it may be several minutes between strokes of that plunger feeder 74.

The length of stroke of each plunger feeder 74 is preferably controlled by a signal from controller 16. Alternatively, the length of stroke of each plunger feeder 74 may be individually controlled by limit switches (not shown).

It should be understood that other types of material pushers can be used in conjunction with the present invention. The material pusher does not necessarily require mechanisms such as plunger feeders 74 which exert force directly against the particulate material. For instance, the material pusher can be a vibrator or any other apparatus which when activated causes the particulate material to flow through the chamber 12 due to gravity or other force. Workers skilled in the art can imagine other ways to appropriate feed or move particulate material through each chamber 12 when the respective material pusher is activated, and such that the particulate material does not move through the chamber 12 when the respective material pusher is not activated.

The storage bin 38 and the chutes 40 function to provide a supply of particulate material to the preheater chambers 12 to fully replace particulate material which is removed from the chambers 12 by operation of the plunger feeders 74. Each chute 40 forms an effective gaseous fluid barrier between its chamber 12 and the storage bin 38. Because it is relatively long in relation to its cross sectional area and because it is completely filled with limestone, each chute 40 is effective in preventing the flow of ambient air from the storage bin 38 to the chamber 12 attached to that chute 40.

Figure 6:
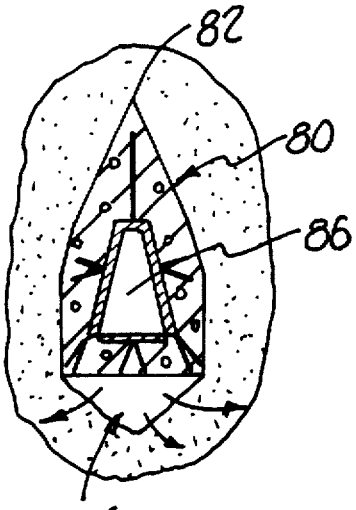
FIG. 6 is a side cross-sectional view taken along line 6—6 of FIG. 4.

As best seen in FIGS. 4, 5 and 6, a gas distribution wall 80 is provided in each chamber 12 in the path of the limestone. The gas distribution wall 80 extends from the inner wall 50 of the chamber 12 to the outer wall 52. The gas distribution wall 80 is preferably centered between adjacent separation walls 54. The gas distribution wall 80 is located above the plunger feeder 74, at the level of the bottom of inner wall 50. The gas distribution wall 80 preferably has a sharply angled upper corner 82 which separates the limestone such that the limestone flows downwardly on opposite sides of the gas distribution wall 80. The limestone does not completely fill the void space left under the gas distribution wall 80, leaving a duct channel 84 which extends radially from the inner wall 50 to the outer wall 52 of the chamber 12. Each duct channel 84 is in open communication at its inner end with the hot kiln gases received from the kiln 36, such that the hot kiln gases flow unimpeded directly into the duct channels 84. The hot kiln gases are then released outwardly into the limestone from the duct channels 84 across the full radial extent of the chamber 12. The gas distribution walls 80 thus help to distribute the flow of hot kiln gases more widely and more uniformly across the chamber 12 from the inner wall 50 to the outer wall 52.

Because of the high temperature of the hot gases, the gas distribution wall 80 is constructed in a tube shape with a hollow interior 86. The hollow interior 86 forms a passage for ambient air to cool the gas distribution wall 80. Cooling of the gas distribution walls 80 may be necessary even though the gas distribution walls 80 are insulated by refractory material.

Preferably, the separation walls 54 have a thickness sufficient to also act as a conduit for gas to flow radially. As best seen in FIG. 8, the limestone does not completely fill the void space left under the separation wall 54, leaving a duct channel 88 which extends radially from the inner wall 50 to the outer wall 52 of the chamber 12. Similar to the duct channels 84 created by the gas distribution walls 80, the duct channels 88 are in open communication at the inner radius of the chamber 12 with the hot kiln gases received from the kiln 36, such that the hot kiln gases flow unimpeded directly into the duct channels 88. The hot kiln gases are released into the limestone across the full radial extent of each chamber 12, both along the gas distribution wall 80 and along the two separation walls 54 defining the chamber 12. The separation walls 54 thus help to distribute the flow of hot kiln gases more widely and more uniformly across the chamber 12 from the inner wall 50 to the outer wall 52.

Workers skilled in the art will appreciate that, due to the creation of duct channels 88 of separation wall 54, the preheater 10 will work sufficiently well even absent gas distribution walls 80. Gas distribution walls 80 may accordingly be omitted in some designs.

The separation walls 54 allow cleaning of a single chamber 12 without emptying of the other chambers 12. For instance, dust accumulation at the refractory nose 83 or buildup at other points can be separately removed from any of the chambers 12. Cleaning is accomplished by closing the gas outlet damper 68, stopping the stone flow through the stone chute 40, and operating the plunger feeder 74 to remove the material from that chamber 12. The operator may then open the access door 58 (as shown by arrow **58*a* in FIG. 5) and manually remove the buildup material by rodding, air lancing, etc. Once the accumulation is removed, stone is allowed to flow through the stone chute 40 into the preheater chamber 12 and then the damper 68 is opened to allow full gas flow through the preheater chamber 12. Having separate access doors 58 for each chamber 12 allows a problem identified within a particular chamber 12 to be independently addressed without shutting down and cleaning out the entire preheater 10**.

As shown in FIG. 5, the sensor 20 for each chamber 12 is preferably provided by a thermocouple located in each gas outlet 66. Workers skilled in the art will appreciate that temperature, flow rate or pressure measurements can also be taken at other locations within each chamber, such as within the duct channels 84, 88. Taking measurements at the exhaust outlet 66 allows measurement which is generally at a lower temperature. Taking measurements at the exhaust outlet 66 also places the sensor 20 in a location where it is less likely to be damaged, worn or clogged by the flow of the limestone or other particulate material and dust created thereby. As explained above, the information from sensor 20 is used by the controller 16 to automatically control the preheating process.

The preferred method to control the preheating process is to automatically control the cycle frequency of each plunger feeder 74 relative to the other plunger feeders 74. For example, the frequency of each of the plunger feeders 74 for a typical flow rate may be six cycles per hour. If the exit gas temperature is higher for one chamber 12, then an extra stroke is provided to the plunger feeder 74 for that chamber 12. The extra stroke increases the material flow rate through that chamber 12 and causes more cool material to enter the chamber 12. Additional heat is transferred from the gas to the newly introduced cool material, and the exit gas temperature is reduced.

A second method to control the preheating process is to automatically vary the stroke length of one plunger feeder 74 relative to the other plunger feeders 74. For instance, during normal operation the interior position of the plunger feeder 74 may be limited to less than the maximum plunger stroke, such as 75% of the maximum plunger stroke. If the exit gas temperature in a chamber 12 is high, the stroke length for that plunger feeder 74 is increased to the furthest anterior position, or 100% of the maximum plunger stroke. This will increase the material flow rate through that chamber 12, causing more cool material to enter the chamber 12. Additional heat will be transferred from the gas to the newly introduced cool material, and the exit gas temperature will be reduced.

A third method to control the preheating process is to automatically control and modulate the gas outlet dampers 68 responsive to the gas outlet temperature. Gas flow within a chamber 12 that has a higher outlet temperature is reduced by reducing damper position from full open, causing less heat transfer to occur within that chamber 12 and more heat transfer to occur within other chambers 12. A disadvantage in using damper control is due to the pressure drop of the exhaust gas across the damper 68, which requires the motor of exhaust fan 72 to pump harder and use more electrical energy. It will be appreciated by workers skilled in the art that facets of the preheating process other than those discussed above may be controlled for maximum efficiency.

Because controller 16 has control over the timing of all the plunger feeders 74, the entire system 10 may be controlled to maintain a constant desired throughput of particulate material. For example, if the stroke frequency of one plunger feeder 74 on a ten module preheater 10 is increased from six to seven strokes per hour, then the stroke frequency of the other nine plunger feeders 74 is decreased to 5.88 strokes per hour (i.e., from one stroke every 10 minutes to one stroke every 10.2 minutes). This results in a constant throughput for the preheater 10 of sixty strokes per hour, both before and after the adjustment. The preheater chamber 12 which registered a higher exhaust temperature prior to the adjustment operates at a higher throughput, causing its outlet gas temperature to decrease to match the other chambers 12. The constant material flow rate of the overall preheater system allows the kiln 36 to be operated at its most efficient flow rate, and no capacity is lost due to adjustments made in the preheater 10.

Although the present invention has been described with reference to preferred embodiments, workers skilled in the art will recognize that changes may be made in form and detail without departing from the spirit and scope of the invention

What is claimed is:

1. A preheating apparatus for particulate material comprising:

a containment structure defining at least one chamber for preheating of particulate material, the chamber comprising:

a material inlet for receiving particulate material into the chamber;

a material outlet for discharging particulate material out of the chamber after preheating;

a fluid inlet for receiving heated fluid into the chamber;

a fluid exhaust for exhausting fluid from the chamber after the fluid has passed through the particulate material in the chamber;

a sensor for sensing a parameter of the fluid after the fluid has passed through the particulate material in the chamber;

a material pusher for moving particulate material through the chamber at a selected rate; and a controller which controls operation of the material pusher as a function of the sensed parameter.

2. The preheating apparatus of claim 1, further comprising at least one separation wall which separates the containment structure into a plurality of substantially distinct chambers, each of the chambers having at least one sensor and at least one material pusher, wherein operation of each of the material pushers is separately controlled as a function of the sensed parameter for its respective chamber.

3. The preheating apparatus of claim 2 wherein the particulate material travels downward through the containment structure and the fluid flows upward through the particulate material, and the separation wall is a vertical wall.

4. The preheating apparatus of claim 3 wherein the containment structure further comprises a floor, wherein the separation wall has a bottom edge which is raised above the floor, and wherein the separation wall has a sufficient thickness so that a space is left in the particulate material immediately underneath the bottom edge of the separation wall, the space acting as a conduit for fluid to flow transversely through the chamber.

5. The preheating apparatus of claim 2 wherein the controller adjusts a rate at which each material pusher moves particulate material respective to the rates of the other material pushers, and wherein the controller maintains the combined rates of the material pushers constant.

6. The preheating apparatus of claim 2 wherein each chamber further includes an access door for permitting each individual chamber to be cleaned independent of other chambers.

7. The preheating apparatus of claim 1, wherein the parameter is the temperature of the fluid being exhausted from the chamber.

8. The preheating apparatus of claim 1, wherein the fluid is hot gas, further comprising a fan for propelling hot gas through particulate material in the chamber.

9. The preheating apparatus of claim 1 wherein the material pusher includes a plunger feeder within the chamber, the plunger feeder being reciprocally movable toward and away from the material outlet of the chamber for moving particulate material through the material outlet, wherein the controller adjusts movement of the plunger feeder as a function of the sensed parameter.

10. The preheating apparatus of claim 9 wherein the controller varies a frequency of reciprocation of the plunger feeder as a function of the sensed parameter.

11. The preheating apparatus of claim 9 wherein the controller varies a stroke distance of the plunger feeder as a function of the sensed parameter.

12. The preheating apparatus of claim 9 wherein the controller activates the plunger feeder intermittently, and wherein the controller varies the duration between activations of the plunger feeder as a function of the sensed parameter.

13. The preheating apparatus of claim 9, wherein the particulate material travels downward through the containment structure and the fluid flows upward through the particulate material, and further comprising:

a floor; and at least one separation wall which extends vertically to separate the containment structure into a plurality of chambers, each of the chambers having at least one sensor and at least one plunger feeder, wherein the separation wall has a bottom edge which is raised above the floor, and wherein the bottom edge of the separation wall is above the plunger feeder to minimize wear of the separation wall by particulate material being pushed by the plunger feeder.

14. The preheating apparatus of claim 1 in combination with a kiln which provides a supply of heated fluid to the fluid inlet and receives the preheated particulate material from the material outlet.

15. A method of preheating particulate material, comprising:

moving particulate material through a first chamber at a first selected rate of movement;

moving heated fluid through the particulate material in the first chamber;

sensing a parameter of the fluid after the fluid has passed through the particulate material in the first chamber;

controlling the first selected rate of movement of the particulate material through the first chamber as a function of the sensed parameter.

16. The method of claim 15 wherein the sensed parameter is fluid temperature.

17. The method of claim 15 further comprising:

moving particulate material through a second chamber at a second selected rate of movement;

moving heated fluid through the particulate material in the second chamber;

sensing a parameter of the fluid after the fluid has passed through the particulate material in the second chamber;

controlling the second selected rate of movement of the particulate material through the second chamber relative to the first selected rate of movement of particulate material through the first chamber as a function of the respective sensed parameters.

18. The method of claim 15, wherein a material pusher is used to move particulate material through the first chamber, the material pusher including a plunger feeder within the first chamber which is reciprocally movable for pushing particulate material through the first chamber, the method further comprising the step of:

varying the rate at which the plunger feeder reciprocates as a function of the sensed parameter.

19. The method of claim 15, wherein a material pusher is used to move particulate material through the first chamber, the material pusher including a plunger feeder within the first chamber which is reciprocally movable for pushing particulate material through the first chamber, the method further comprising the step of:

varying stroke distance of the plunger feeder as a function of the sensed parameter.

20. A preheating apparatus for particulate material comprising:

a containment structure defining at least one chamber for preheating of particulate material, the chamber comprising:

a material inlet for receiving particulate material into the chamber;

a material outlet for discharging particulate material out of the chamber after preheating;

a gas inlet for receiving hot gas into the chamber;

a gas exhaust for discharging gas from the chamber after the gas has passed through the particulate material in the chamber;

a sensor for sensing a parameter of one of the particulate material at discharge and the gas at discharge;

a material pusher for moving particulate material through the chamber at a rate;

a gas movement system for moving gas through the particulate material in the chamber at a rate; and a controller which controls operation of at least one of the material pusher and the gas movement system as a function of the sensed parameter.

21. A preheating apparatus for particulate material comprising:

a plurality of preheat chambers, each preheat chamber comprising:

a material inlet for receiving particulate material into the preheat chamber;

a material outlet for discharging particulate material out of the preheat chamber after preheating;

a fluid inlet for receiving heated fluid into the preheat chamber;

a fluid exhaust for exhausting fluid from the preheat chamber after the fluid has passed through the particulate material in the preheat chamber;

means for sensing a parameter of the fluid in each preheat chamber; and means for controlling preheating in each of the preheat chambers as a function of the parameter sensed for that preheat chamber.

* * * * *